US008561683B2

(12) United States Patent
Wood et al.

(10) Patent No.: US 8,561,683 B2
(45) Date of Patent: Oct. 22, 2013

(54) WELLBORE TUBULAR CUTTER

(75) Inventors: Jeffrey D. Wood, Keller, TX (US); Timothy Edward LaGrange, Rainbow, TX (US); Matthew Clay, Burleson, TX (US)

(73) Assignee: Owen Oil Tools, LP, Houston, TX (US)

( * ) Notice: Subject to any disclaimer, the term of this patent is extended or adjusted under 35 U.S.C. 154(b) by 0 days.

(21) Appl. No.: 13/239,008

(22) Filed: Sep. 21, 2011

(65) Prior Publication Data

US 2012/0067578 A1 Mar. 22, 2012

Related U.S. Application Data

(60) Provisional application No. 61/385,276, filed on Sep. 22, 2010.

(51) Int. Cl.
*E21B 29/02* (2006.01)

(52) U.S. Cl.
USPC ..... 166/63; 166/298; 166/299; 166/55; 175/4.6; 89/1.15

(58) Field of Classification Search
USPC ..... 166/63, 55, 55.7, 298, 299; 175/4.6; 89/1.15
See application file for complete search history.

(56) References Cited

U.S. PATENT DOCUMENTS 2,684,030 A 7/1954 Muskat et al.
2,839,997 A 6/1958 Church et al.
3,013,491 A 12/1961 Poulter
3,053,182 A 9/1962 Christopher
3,057,295 A 10/1962 Christopher
3,108,540 A 10/1963 Fletcher
3,233,688 A 2/1966 Bell
3,245,485 A 4/1966 Bell
3,599,567 A 8/1971 Graham et al.
3,626,850 A 12/1971 Davis
3,799,055 A 3/1974 Irish, Jr. et al.
3,872,709 A 3/1975 Pagano
3,893,395 A 7/1975 Kilmer
3,938,440 A 2/1976 Dooley et al.
4,042,019 A 8/1977 Henning
4,184,430 A 1/1980 Mock
4,354,433 A 10/1982 Owen
4,425,850 A 1/1984 Grossler
4,512,411 A 4/1985 Pringle
4,724,105 A 2/1988 Owen
4,753,170 A 6/1988 Regalbuto et al.
4,881,445 A 11/1989 Hayes
4,883,118 A 11/1989 Preston
4,932,239 A 6/1990 Regalbuto
4,961,381 A 10/1990 McLaughlin
5,046,563 A 9/1991 Engel et al.
5,060,573 A 10/1991 Montgomery et al.
5,129,322 A 7/1992 Christopher et al.

(Continued)

*Primary Examiner* — Yong-Suk (Philip) Ro
(74) *Attorney, Agent, or Firm* — Mossman, Kumar & Tyler, PC

(57) ABSTRACT

An apparatus and a method for cutting a wellbore tubular may include an upper section and a lower section mating at a juncture plane defined by a plane transverse to the longitudinal axis of the wellbore tubular. Each section may include a support plate having a passage, a liner positioned adjacent to the support plate, and an energetic material disposed between the support plate and the liner. An initiator having a shaft may be positioned in the passages of the upper section and the lower section.

13 Claims, 4 Drawing Sheets

(56) References Cited

U.S. PATENT DOCUMENTS

| | | | |
|---|---|---|---|
| 5,241,891 | A | 9/1993 | Hayes et al. |
| 5,377,594 | A | 1/1995 | Alford |
| 5,385,098 | A | 1/1995 | Lindqvist et al. |
| 5,392,684 | A | 2/1995 | Renfro et al. |
| 5,575,331 | A | 11/1996 | Terrell |
| 5,698,814 | A | 12/1997 | Parsons et al. |
| 5,714,712 | A | 2/1998 | Ewick et al. |
| 5,780,764 | A | 7/1998 | Welch et al. |
| 5,859,383 | A | 1/1999 | Davison et al. |
| 5,992,289 | A | 11/1999 | George et al. |
| 6,016,753 | A | 1/2000 | Glenn et al. |
| 6,076,601 | A | 6/2000 | Mooney, Jr. |
| 6,298,913 | B1 | 10/2001 | Box |
| 6,408,759 | B1 | 6/2002 | Ewick et al. |
| 6,505,559 | B1 | 1/2003 | Joslin et al. |
| 6,634,300 | B2 | 10/2003 | Reese et al. |
| 6,644,099 | B2 | 11/2003 | Bell |
| 6,792,866 | B2 | 9/2004 | Grattan |
| 7,073,448 | B2 | 7/2006 | Bell |
| 7,104,326 | B2 | 9/2006 | Grattan et al. |
| 7,146,913 | B2 | 12/2006 | Bell |
| 7,661,367 | B2 | 2/2010 | Yang et al. |
| 2002/0083860 | A1 | 7/2002 | Shim |
| 2003/0111220 | A1* | 6/2003 | Bell ..... 166/55 |
| 2010/0212480 | A1* | 8/2010 | Bell ..... 89/1.15 |

* cited by examiner

WELLBORE TUBULAR CUTTER

CROSS REFERENCE TO RELATED APPLICATIONS

This application claims priority from U.S. Provisional Patent Application Ser. No. 61/385,276 filed on Sep. 22, 2010 the disclosure of which is incorporated herein by reference in its entirety.

BACKGROUND OF THE DISCLOSURE

1. Field of Disclosure

The present disclosure relates to an apparatus and method for cutting wellbore tubulars.

2. Description of the Related Art

Conventional devices for cutting tubing in oil or gas wells have used either mechanical cutters or explosive charges to separate the tubing into two segments. Mechanical cutters are lowered into the well to the desired point, and generally include teeth or other cutting elements that rotate or otherwise move and cut through the tubing to separate it. Explosive-charge cutting devices, on the other hand, use a shaped explosive charge that is lowered to the desired point in the well and then detonated. The explosive charge is shaped so that it causes the tubing to separate at the desired point when it is detonated. The present disclosure addresses the need to improve the performance of such tools.

SUMMARY OF THE DISCLOSURE

In aspects, the present disclosure provides an apparatus for cutting a wellbore tubular. The apparatus may include an upper section and a lower section mating at a juncture plane defined by a plane transverse to the longitudinal axis of the wellbore tubular. Each section may include a support plate having a passage, a liner positioned adjacent to the support plate, and an energetic material disposed between the support plate and the liner. An initiator having a tubular portion may be positioned in the passages of the upper section and the lower section.

In aspects, the present disclosure provides a method of severing a subterranean wellbore tubular. The method may include severing the wellbore tubular using a tool having an upper section and a lower section mating at a juncture plane defined by a plane transverse to the longitudinal axis of the wellbore tubular. Each section may include a support plate having a passage, a liner positioned adjacent to the support plate, and an energetic material disposed between the support plate and the liner. An initiator having a tubular portion may be positioned in the passages of the upper section and the lower section.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the disclosure, taken in conjunction with the accompanying drawings, in which like elements have been given like numerals and wherein.

DETAILED DESCRIPTION OF THE DISCLOSURE

Figure 1:
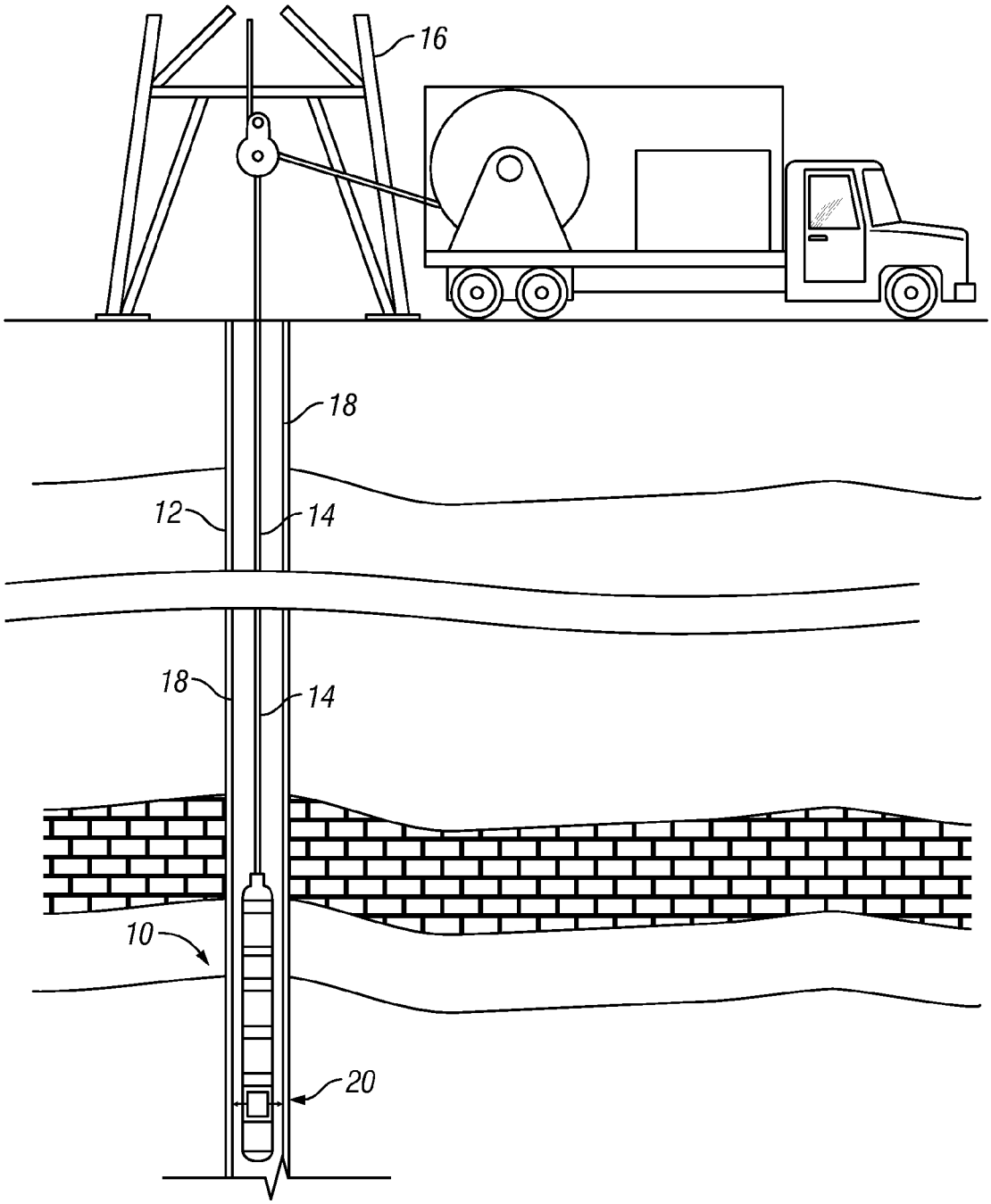
FIG. 1 is a schematic sectional view of one embodiment of a rig for deploying a tubular cutting device in accordance with one embodiment of the present disclosure.

As will become apparent below, the present disclosure provides an efficient device that severs a wellbore tubular. As will be appreciated, the present disclosure is susceptible to embodiments of different forms. There are shown in the drawings, and herein will be described in detail, specific embodiments of the present disclosure with the understanding that the present disclosure is to be considered an exemplification of the principles of the present disclosure, and is not intended to limit the disclosure to that illustrated and described herein.

Referring initially to FIG. 1, there is shown a tool string 10 configured to circumferentially sever a selected wellbore tubular 18 in a wellbore 12. While a land system is shown, the teachings of the present disclosure may also be utilized in offshore or subsea applications. A carrier 14 conveys the tool string 10 into the wellbore 12. As shown, the carrier 14 is a non-rigid carrier, such as a wireline, suspended in the wellbore 12 from a rig 16. Other suitable non-rigid carriers include slick-lines and e-lines. In other applications, a rigid carrier, such as coiled tubing or jointed drill pipe, may be used as the carrier 14. The tool string 10 may include a pyrotechnic tubular cutter device 20 for forming a circumferential cut in a wellbore tubular, such as a production tubing 18. This circumferential cut results in two separated sections of the production tubing 18. The device 20 may be actuated by a signal, such as an electrical signal, a pressure pulse or pressure increase, a drop bar, a timer, or any other suitable mechanism. As shown, the tool string 10 is positioned inside a production tubing 18. It should be understood, however, that any wellbore tubular may be severed using the tubular cutting device 20, e.g., casing, liner, jointed drill pipe, coiled tubing, etc.

Figure 2:
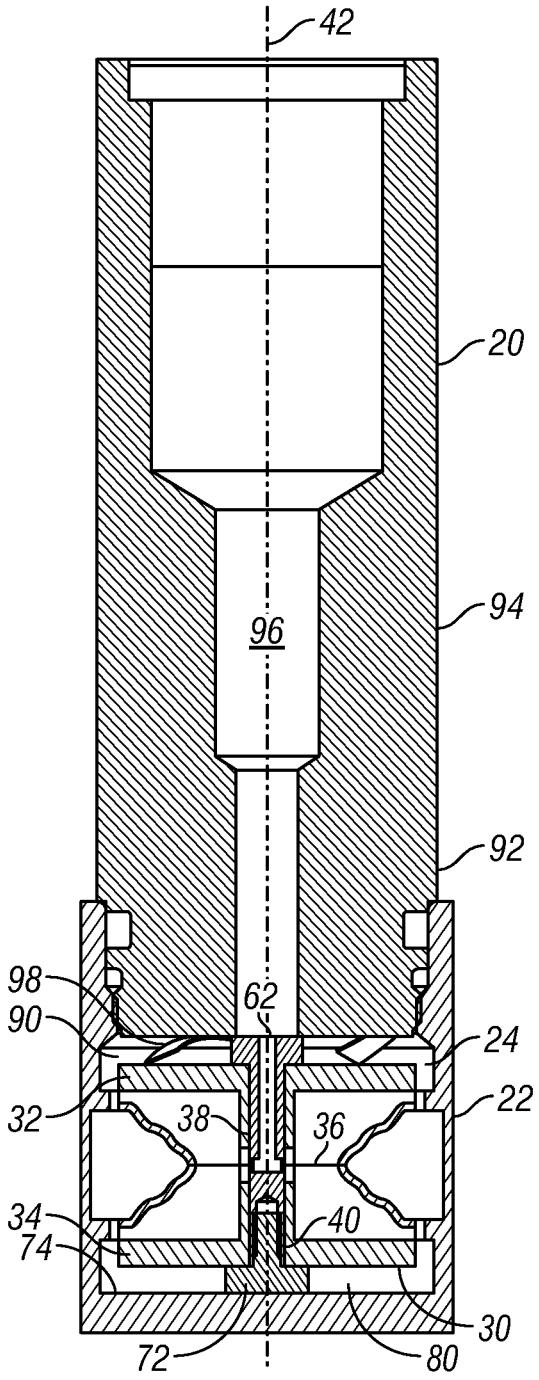
FIG. 2 is a section view of one illustrative cutting device in accordance with the present disclosure.

Referring now to FIG. 2, there is shown one embodiment of a tubular cutting device 20 made in accordance with the present disclosure. The tubular cutting device 20 may include a receptacle 22 having an interior chamber 24 for receiving a charge assembly 30. The charge assembly 30 includes an upper portion 32 and a lower portion 34 that mate along a juncture plane 36. In embodiments, the juncture plane 36 is orthogonal or at least angularly offset from the longitudinal axis 42 of the tubular cutting device 20. Each section 32, 34 can include a central bore 38, 40, respectively, that is aligned with the longitudinal axis 42 of the tubular cutting device 20. The longitudinal axis 42 may be co-linear with the wellbore 12 (FIG. 1) or the wellbore tubular to be severed. In many embodiments, the upper portion 32 and the lower portion 34 may be characterized as mirror images of one another. As used herein, references to radial direction (e.g., radially inward or radially outward) will be with reference to the axis 42.

Figure 3:
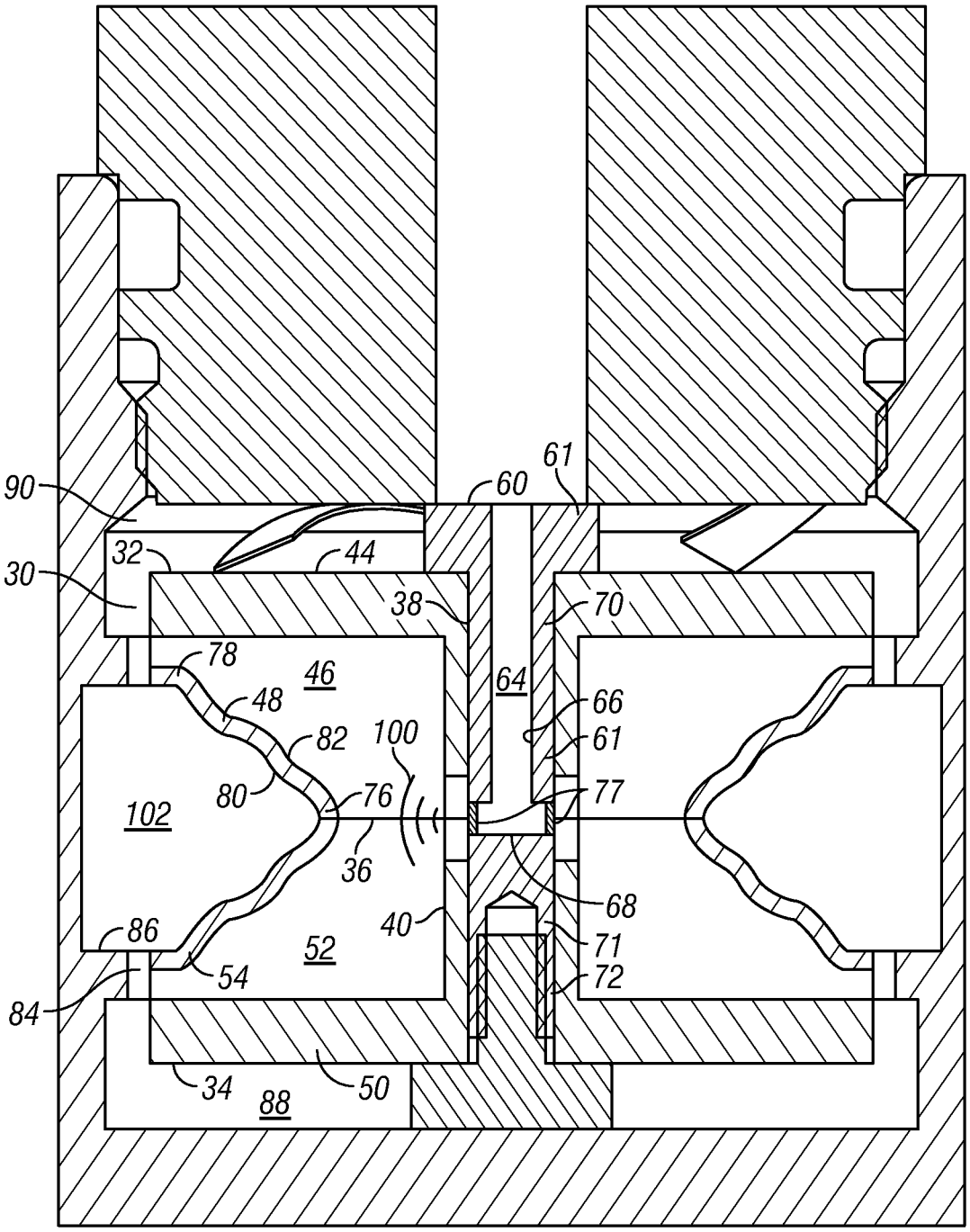
FIG. 3 is an enlarged sectional view of a charge assembly made in accordance with one embodiment of the present disclosure.
Figure 4:
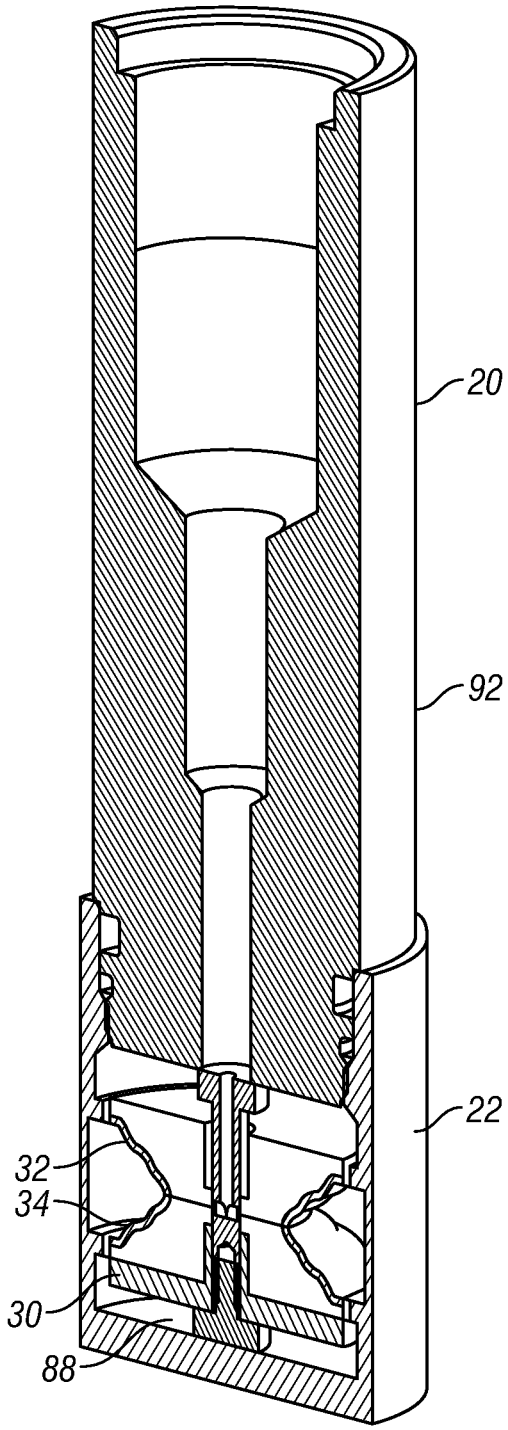
FIG. 4 is a sectional isometric view of a cutting device made in accordance with one embodiment of the present disclosure.

Referring now to FIG. 3, the charge assembly 30 is shown in greater detail. In one embodiment, the upper portion 32 of the charge assembly 30 may include a support plate 44, an energetic material 46, and an upper portion liner 48. Likewise, the lower portion 34 of the charge assembly 30 may include a support plate 50, an energetic material 52, and a lower portion liner 54. As best shown in FIG. 4, the upper portion 32 and the lower portions 34 may be formed as ring-like or frusto-conical structures.

The energetic material 46, 52, which may be the same material, may include one or more materials such as oxidizers, fuels (e.g., metals, organic material, etc.), propellant materials (e.g., sodium nitrate, ammonium nitrate, etc.), explosive materials (e.g., RDX, HMX and/or HNS, etc.), binders and/or other suitable materials. The explosive material may be pressed under sufficient pressure to provide a free standing solid "disk" or pellet of the desired configuration. Alternatively, the explosive material may be pressed under sufficient pressure between the support plate 44, 50 and the liner 48, 54. The support plates 44, 50, which may be referred to as backup plates, may be formed from a metal, such as steel or a hardened plastic. The support plates 44, 50 may have a flat exterior surface and an internal profile for receiving the disk energetic material 46, 52.

The liners 48, 54 are formed to cooperatively form an annular cutting jet that radiates outward to form a substantially contiguously circumferential penetration of the wellbore tubular. This penetration is, therefore, contrasted from the localized tunnel formed by a conventional shaped charged device. The material matrix of the liners 48, 54 may be formed from one or more different materials. The material matrix may include a powdered metal mixture that is compressed at high pressures, a solid metal, or a solid metal mixture. The base material(s) used in the mixture(s) in order to achieve the desired effect from the explosive force may include non-metals, such as diamonds, and high density metal(s). Common high density metals used can include copper, tungsten, and tungsten carbide but other high density metals can also be used.

The mixture of metals may include one or more binder materials to form the material matrix. Binder materials include, but are not limited to, elastomers or metals including aluminum, nickel, lead, silver, gold, zinc, iron, tin, antimony, tantalum, cobalt, bronze and uranium. In some embodiments, the high density material (e.g., tungsten carbide) may be coated with a coating material. Powdered graphite is also commonly used and serves a lubricant during the formation of the liner. In one configuration, the binder material and/or the coating material can have greater ductility than the base material; e.g., tungsten carbide may be coated with copper. It should be understood that the identification of a material in one category (e.g., base metal) does not preclude that material from being used in a different category (e.g., coating material).

Referring now to FIGS. 2 and 3, an initiator 60 may be disposed in the bore(s) 38, 40. The initiator 60, which may be referred to as a booster cartridge, includes a quantity of energetic material 62 that, when activated, detonates the charge assembly 30. In one embodiment, the initiator 60 may have a tubular or sleeve-like section that includes a bore 64 configured to direct a detonation shock wave along the juncture plane 36. In one embodiment, the bore 64 includes an axial section 66 that is aligned with the longitudinal axis 42 and one or more radial sections 68 that are aligned with, or even bisected by, the juncture plane 36. These radial sections may be passages that have a varying or a non-varying cross-sectional shape. That is, for example, the radial section 68 may have a non-varying circular cross-section through substantially all of the initiator 60. The radial sections 68 may direct the shock wave along the shortest radial distance to the most radially inward tip of the apex 76. Thus, a shock wave created by the energetic material in the radial sections 68 is directed primarily radially outward such that the upper energetic material 46 and the lower energetic material 52 are detonated at substantially the same time.

Additionally, in certain embodiments, the initiator 60 may be formed as a shaft 61 having a proximate end 70 positioned in the upper charge section 32 and a distal end 71 that is positioned in the lower charge section 34. The distal end 71 may be configured to attach to the fastening element 72 as shown in FIG. 3. For example, the distal end 71 may include internal threads that mate with external threads of the fastening element 72. In such embodiments, the initiator 60 and the fastening element 72 cooperate to secure and compress the upper section and the lower section 32, 34. It should be appreciated that the shaft 61 may be machined to a relatively precise tolerance to laterally align and lock the upper charge section 32 to the lower charge section 34. That is, the initiator 60 may prevent the charge sections 32, 34 from sliding or moving laterally relative to one another. Further, in certain embodiments, the fastening element 72 may include a pedestal portion that provides a pre-determined amount of spatial offset between the lower section 34 and a bottom interior surface 74 of the receptacle 22. In certain embodiments, the initiator 60 may include a partially unconsolidated explosive material that may not remain in a substantially solid condition during handling. In such embodiments a retention film, tape or other member 77 may be used to seal the explosive material in the radial bores.

Referring now to FIG. 3, the charge assembly 30 will be discussed in greater detail. When assembled, the liners 48, 54 mate at the juncture plane 36 to form a cone-like cross-sectional profile. The profile may be considered to have an apex portion 76 and a radially outward skirt portion 78. The outer liners 48, 54 may be defined by an outer surface 80 and an inner surface 82. In some embodiments, the surfaces 80, 82 may be defined by a line having one continuous slope. In other embodiments, the surfaces 80, 82 may be defined by a line having two or more slopes, wherein the slope changes at an inflection point. In such embodiments, the surfaces 80, 82 may have the same number of inflection points or a different number of inflection points. Moreover, the inflection point(s) may be at the same general location(s) or at different locations. The inflection point(s) may be a relatively distinct point or a gradual change in slope, i.e., an arcuate shape.

In certain embodiments, the liners 48, 54 are configured to form a gap 84 between an inner side wall 86 and the radially outward end of (i) the skirt portion 78, the explosive material 46, 52, and (iii) the support plates 44, 50. Furthermore, the gap 84 is sized such that after detonation, the liners 48, 54 expand radially outward to traverse and close the gap 84 to form a gas-tight seal. However, the gap 84 is further sized to allow the high-pressure gas formed by the detonated explosive material 46, 52 to flow into the space 88 between the lower section 34 and the inner surface 74 and flow into a space 90 between the upper section 32 and a closure assembly 92 (FIG. 2).

Referring now to FIG. 2, there is shown one embodiment of a closure assembly 92 for securing the charge assembly 30 within the receptacle 22. In one embodiment, the closure assembly 92 may include a mandrel 94 that engages with the receptacle 22. The mandrel 94 may include a bore 96 for receiving a firing head (not shown), a detonator (not shown), a detonator cord (not shown) or other suitable device for activating the initiator 60. Additionally, in some embodiments the closure assembly 92 may include a resilient clamping member 98. In some embodiments, the clamping member 98 may be a finger spring washer that applies a compressive axial force to the charge assembly 30.

Referring now to FIG. 4, a sectional isometric view of a cutting device made in accordance with one embodiment of the present disclosure is shown. The tubular cutting device 20 may include a closure assembly 92 and a receptacle 22. A charge assembly 30 and a space 88 are also shown.

Referring now to FIGS. 1-4, in an exemplary deployment, the tool string 10 is conveyed to a specified location in the wellbore 12. Thereafter, the cutting device 20 is activated by a suitable signal. In one arrangement, the signal initiates the initiator 60 by detonating the explosive material 62. The detonation of the explosive material 62 generates a shock wave, or high-pressure wave, that is directed by the radial bore(s) 68 along the juncture plane 36. Waves 100 of FIG. 3 illustrate the shock wave traveling along the juncture plane 36. As should be appreciated, the wave 100 can apply a generally symmetric shock to the upper energetic material 46 and the lower energetic materials 52.

The energetic materials 46, 52 detonate and produce a high-pressure gas that shapes the liners 48, 54 into a cutting jet. During the jet formation, the skirt portions 78 of the liners 48, 54 shift radially outward and form gas-tight seals with the side walls 86. Thus, the high-pressure gas formed by the energetic material 46, 52 is prevented from entering the region 102 wherein the jet is being formed; e.g., the area within the concave side of the liners 48, 54. The jet expands radially outward and penetrates through the adjacent wellbore tubular to form two substantially separate sections of that wellbore tubular. During this time, the compressive forces applied by the initiator 60 and the fastening element 72 may assist in providing rigidity to the charge assembly 30 and thereby further enhance jet formation.

From the above, it should be appreciated that what has been described includes, in part, an apparatus for cutting a wellbore tubular. The apparatus may include an upper section and a lower section mating at a juncture plane defined by a plane transverse to the longitudinal axis of the wellbore tubular, and an initiator having a tubular portion positioned in the passages of the upper section and the lower section. Each section may include a support plate having a passage; a liner positioned adjacent to the support plate; and an energetic material disposed between the support plate and the liner.

The liners of the apparatus may be ring-shaped. The initiator of the apparatus may substantially laterally lock the upper section and the lower section. A fastener may be configured to mate with an end of the tubular member. The fastener and the initiator may cooperate to compress the upper section and the lower section. The initiator may include a longitudinal bore and at least one radial bore. More than one radial bore may be orthogonal to the longitudinal bore. The juncture plane may bisect the radial bore(s).

The apparatus may have a housing configured to receive the upper section and the lower section. A gap may separate the liners from an interior surface of the housing.

From the above, it should be appreciated that what has been described includes, in part, a method of severing a subterranean wellbore tubular. The method may include severing the wellbore tubular using a tool. The tool may have an upper section and a lower section mating at a juncture plane defined by a plane transverse to the longitudinal axis of the wellbore tubular. Each section may include a support plate having a passage; a liner positioned adjacent to the support plate; and an energetic material disposed between the support plate and the liner. The tool may have an initiator having a tubular portion positioned in the passages of the upper section and the lower section. The liners described within the method may be ring-shaped. The method may include laterally locking the upper section to the lower section by using the initiator.

As used herein, the terms "up" and "down", "upper" and "lower", "upwardly" and downwardly", "above" and "below"; and other like terms indicating relative positions above or below a given point or element are used in this description to more clearly describe some embodiments of the disclosure. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

What is claimed is:

1. An apparatus for cutting a wellbore tubular, comprising:
a receptacle engaging with a mandrel;
an upper section and a lower section in the receptacle, the upper and the lower sections mating at a juncture plane defined by a plane transverse to a longitudinal axis of the wellbore tubular, wherein the each section includes a support plate having a passage, a ring-shaped liner positioned adjacent to the support plate, an energetic material disposed between the support plate and the liner, and a gap separating the liner from an interior surface of the receptacle, wherein the gap allows fluid communication between a space between the lower section and a lower inner space of the receptacle and a jet forming region; and
an initiator having a shaft traversing the upper section and the lower section, wherein the initiator includes at least one radial bore that is orthogonal to the longitudinal axis and is bisected by the juncture plane; and
a fastener engaging the shaft to compressively secure the upper section with the lower section, the fastener further having a pedestal portion that separates the lower section from the receptacle.

2. The apparatus of claim 1, wherein the liner is configured to radially expand upon detonation of the energetic material to close the gap and form a gas tight seal with the interior surface.

3. An apparatus for cutting a wellbore tubular, comprising:
a receptacle engaging with a mandrel;
an upper section and a lower section positioned in the receptacle and mating at a juncture plane defined by a plane transverse to a longitudinal axis of the wellbore tubular, where the each section includes a support plate having a passage, a liner positioned adjacent to a support plate, and an energetic material disposed between the support plate and the liner; and
an initiator positioned in the passage, wherein the initiator includes a shaft having a proximate end positioned in the upper section and a distal end positioned in the lower section;
a fastener attached to the distal end of the shaft, wherein the upper section and the lower section being compressed by the attachment of the fastener with the distal end of the shaft; and a gap separating the liner from the interior surface of the receptacle, wherein a first portion of the gap forms a seal between the liner and the interior surface of the receptacle after detonation of the energetic material, wherein the seal prevents a gas formed by the energetic material from entering a jet forming region, and wherein a second portion of the gap allows the gas to flow into a first space between the lower section and a lower inner surface of the receptacle and flow into a second space between the upper section and an upper inner surface of the receptacle.

4. The apparatus of claim 3, wherein the liner is ring-shaped.

5. The apparatus of claim 3, wherein the initiator substantially laterally locks the upper section and the lower section.

6. The apparatus of claim 3, wherein the initiator includes a longitudinal bore and at least one radial bore.

7. The apparatus of claim 6, wherein the at least one radial bore is orthogonal to the longitudinal bore.

8. The apparatus of claim 6, wherein the juncture plane bisects the at least one radial bore.

9. A method of severing a subterranean wellbore tubular, comprising:

providing a severing tool having:

a receptacle engaging with a mandrel;

an upper section and a lower section mating at a juncture plane defined by a plane transverse to the longitudinal axis of the wellbore tubular, wherein the each section includes a support plate having a passage, a liner positioned adjacent to the support plate, an energetic material disposed between the support plate and the liner, a gap separating the liner from an interior surface of the receptacle, and an initiator having a shaft, wherein the shaft has a proximate end positioned in the upper section and a distal end positioned in the lower section; and compressing the upper section and the lower section by engaging a fastener to the distal end of the shaft;

positioning the severing tool in the wellbore tubular;

severing the wellbore tubular by firing the severing tool; and creating a seal between the liner and the interior surface of the receptacle in a first portion of the gap after detonation of the energetic material, wherein the seal prevents a gas formed by the energetic material from entering a jet forming region, maintaining a second portion of the gap to allow the gas to flow into a first space between the lower section and a lower inner surface of the receptacle and flow into a second space between the upper section and an upper inner surface of the receptacle.

10. The method of claim 9, wherein the liner is ring-shaped.

11. The method of claim 9, further comprising laterally locking the upper section to the lower section by using the initiator.

12. The method of claim 9, wherein the initiator includes a longitudinal bore and at least one radial bore.

13. The method of claim 12, wherein the at least one radial bore is orthogonal to the longitudinal bore.

* * * * *